United States Patent [19]

Imboden

[11] 4,000,630

[45] Jan. 4, 1977

[54] SEAMLESS PANTY HOSE AND METHOD

[75] Inventor: Walter H. Imboden, Burlington, N.C.

[73] Assignee: Burlington Industries, Inc., Greensboro, N.C.

[22] Filed: May 22, 1973

[21] Appl. No.: 362,923

[52] U.S. Cl. ..... 66/177

[51] Int. Cl.[2] ..... A41B 9/00; A41B 11/00

[58] Field of Search ..... 66/177, 185–187, 66/176; 2/224 R, 409

[56] References Cited

UNITED STATES PATENTS

| | | | |
|---|---|---|---|
| 256,532 | 4/1882 | Appleton | 66/177 |
| 358,383 | 2/1887 | Clow | 66/187 |
| 402,202 | 4/1889 | Sutton | 66/177 |
| 490,241 | 1/1893 | Black | 66/187 |
| 1,117,934 | 11/1914 | West | 66/187 |
| 1,789,494 | 1/1931 | Page | 66/187 |
| 1,981,136 | 11/1934 | Bloom | 66/176 |
| 2,511,720 | 6/1950 | Lacks | 66/177 |
| 2,950,611 | 8/1960 | Getaz | 66/186 |
| 2,962,884 | 12/1960 | Garrov et al. | 66/177 |
| 3,109,301 | 11/1963 | Garrov et al. | 66/177 |
| 3,221,522 | 12/1965 | Neber | 66/185 |
| 3,670,529 | 6/1972 | Fregeolle | 66/177 |
| 3,673,821 | 7/1972 | Johnson | 66/177 |
| 3,802,229 | 4/1974 | Fregeolle | 66/177 |
| R27,886 | 1/1974 | Johnson | 66/177 |

FOREIGN PATENTS OR APPLICATIONS

| | | | |
|---|---|---|---|
| 2,032,241 | 11/1970 | France | 66/177 |
| 1,807,974 | 7/1970 | Germany | 66/177 |
| 1,800,166 | 4/1970 | Germany | 66/177 |
| 1,958,569 | 8/1970 | Germany | 66/177 |
| 1,900,189 | 7/1970 | Germany | 66/177 |

*Primary Examiner*—James Kee Chi
*Attorney, Agent, or Firm*—Cushman, Darby & Cushman

[57] ABSTRACT

Seamless one-piece panty hose, integrally knit on a circular knitting machine, has tubular leg and foot portions made by unidirectional rotary knitting, upwardly and outwardly tapering extensions fashioned by reciprocatory knitting at the upper ends of the leg portions and a tubular body portion made by unidirectional rotary knitting in the form of an endless band extending between and connecting the extensions and the upper ends of the leg portions at their inner sides. The lower portion of the tubular body portion forms the crotch area of the garment while its upper portion is slit walewise to form the waist opening. The tubular body portion together with the extensions essentially form the panty part of the garment. Preferably the crotch area is knit with a stitch length differential to constrict and minimize stretchability of the fabric in a walewise direction on this area to achieve better fit.

10 Claims, 2 Drawing Figures

SEAMLESS PANTY HOSE AND METHOD

FIELD OF THE INVENTION

This invention relates to seamless knit two-legged lower body garments, such as panties, wherein tubular blanks are produced on a circular knitting machine and slit longitudinally at a medial portion to provide a waist opening. It has particular reference to one-piece seamless knit panty hose wherein the garment includes not only a panty part, but also leg and foot portions consituting hose. More especially, the invention relates to such garments wherein fit is not sacrificed to economies of manufacture and conversely wherein certain economies of manufacture can be obtained without sacrifice of fit.

BACKGROUND OF THE INVENTION

One approach to knitting of seamless garments of this type is to employ rotary of unidirectional circular knitting in the leg and foot portions of the garment and to use reciprocatory knitting in most or all of the panty part of the garment to fashion the latter, i.e. to coursewise widen or narrow selected portions of the fabric as it is being knit, in order to shape the garment to achieve a better fit and also to enable more size variations. Reciprocatory knitting, however, possesses the disadvantage not only of requiring more machine time with consequent greater production expense, but also of practically limiting stitch choice to plain knitting, i.e. jersey. Thus, the accomplishment of pattern work in reciprocatorily knit areas of the fabric cannot be had. Additionally, the use of elastic yarns, e.g. Spandex, in reciprocatory knitting is almost impossible or at most impractical.

Further, in some instances reciprocatorily knit fashioned areas of fabric are directly connected to other reciprocatorily knit fashioned areas of fabric along gore lines along some portions of which the stitches are under considerable stress. The result is that these stitches are stretched and cause a rather open fabric thereadjacent. The stretched stitches also weaken the fabric. Examples of this type of fashioning are disclosed in the U.S. Pat. Nos. to Garrou et al 2,962,884; 3,109,300; and 3,109,301.

Still another approach to the knitting of seamless panty hose type garments is to knit a substantially cylindrical tube using unidirectional rotary knitting throughout, e.g. as disclosed in the U.S. Pat. No. to Johnson 3,673,821. While this method of making such a garment gives rise to manufacturing economies, it results in a garment having its volume of fabric poorly distributed in the panty part for acquiring a shape to properly fit the human form. In general, there is too much fabric in the crotch area of the garment and insufficient fabric in the rest of the panty part. Some of these objections can be overcome somewhat by the use of partial courses alternating with full courses in the panty part, with the partial courses stopping short of the crotch area of the garment. While this improves the fit to some extent, it requires cutting out or trimming the floated yarn at each end of the partial courses, which consequently increases the cost of manufacture. Futher, such partial courses cause certain areas of the fabric, i.e. the crotch area, to be of relatively thin or flimsy construction with a consequent undesirable esthetic result.

Accordingly, it is an object of this invention to provide a seamless knit two-legged lower body garment, and method of knitting the same, which overcomes many of the aforedescribed disadvantages of prior constructions.

It is another object of this invention to provide a garment of the type described, and a method of knitting the same, which possesses economies of manufacture, as contrasted to such garments which are fashioned throughout all or most of the body part, while providing a better fit than one which is produced by unidirectional rotary knitting throughout.

It is another object of this invention to provide a garment of the type described, and a method of knitting the same, which does not require unidirectional rotary knit partial courses, which would require cutting out or trimming of floated yarns, in order to achieve a good fit.

It is another object of this invention to provide an improved garment of the type described, and a method of knitting the same, which permits the use of a variety of stitch constructions in most of the body part of the garment and also the use of elastic yarns in such parts, to facilitate the construction of fabrics which achieve a better fit of the garment.

It is a further object of this invention to provide an improved garment of the type described wherein the panty part can be shaped in the crotch area by the use of shortened and/or tightened stitches or by a combination of tuck and float stitches.

Other objects and advantages of the invention will be evident from the following description and accompanying drawings in which:

DETAILED DESCRIPTION OF THE INVENTION

Figure 1:
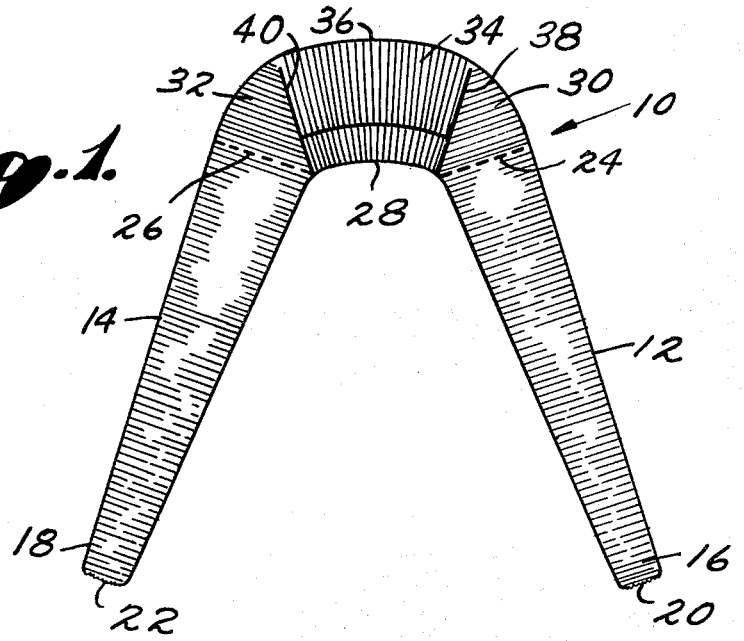
FIG. 1 is a front elevational view of a seamless blank knit in accordance with this invention for making a one-piece panty hose, showing the blank in condition after removal from a knitting machine and prior to being made into a panty hose.

Referring now to the drawings, and especially to FIG. 1, there is shown a knitted blank 10 which includes a pair of seamless tubular legs 12 and 14, including foot portions 16 and 18, knitted in a conventional manner by unidirectional rotary knitting on a circular knitting machine. The foot portions 16 and 18 may have toe portions 20 and 22 that may be closed in the knitting process, as disclosed for example, in the patent to Currier, U.S. Pat. No. Re. 26,581, or have open toe portions which are subsequently closed by a conventional sewing operation. The legs 12 and 14 and foot portions 16 and 18 may be shaped, to some extent, in conventional fashion by the use of graduated stitches, with the final shape being imparted by a boarding operation.

The shade lines in the drawings indicate course direction. It will be noted that the knit courses in the legs 12 and 14 and foot portions 16 and 18 extend circumferentially thereof while the knit wales extend vertically or longitudinally of the tubular legs and foot portions.

At their upper ends, indicated by dotted lines 24 and 26, respectively, the legs 12 and 14 are respectively provided with integrally knit extensions 30 and 32 that are joined to the upper ends of the corresponding legs and extend upwardly therefrom. These extensions 30 and 32 taper outwardly away from each other, as shown, and are formed by reciprocatory knitting, as later described. The major circumferential extent of the extensions 30 and 32, i.e. at their lower ends, preferably is substantially equal to that of the legs 12 and 14 at their upper ends, i.e. at the dotted lines 24 and 26, or such extent may be somewhat less. While only the front of the blank 10 is shown in the drawings, it will be realized that the rear is substantially the same as the front.

Extending between and joining the inner edges of the extensions 30 and 32, at both the front and rear of the blank 10, and also joining the inner edge portions of the upper ends of the legs 12 and 14, is an integrally knit body portion 34 formed by an endless tubular band of unidirectional rotary knit fabric which extends through the crotch area 28 of the blank 10 and upwardly over the waist portion 36 thereof. This body portion 34 is joined to the inner edges of the leg extensions 30 and 32 along gore lines 38 and 40, respectively, formed in the knitting operation as later described. The gore lines 38 and 40 are duplicated at the rear of the blank 10. It will be seen that the knit courses of the body portion 34 extend generally vertically and desirably diverge slightly upwardly while the knit wales of the body portion extend generally horizontally.

Figure 2:
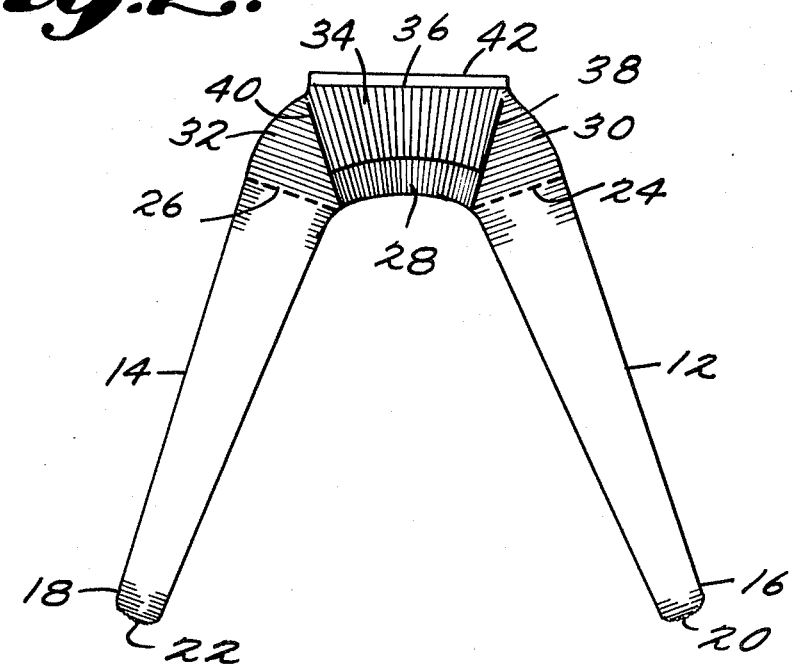
FIG. 2 is a view similar to FIG. 1, but showing the blank made into a panty hose.

When the knitting of the blank 10 is completed, the upper medial portion 36 of the body portion 34 is slit in the walewise direction to provide a waist opening which may be finished to prevent ravelling by sewing a stretchable or elastic band 42 to the edges of the slit, as shown in FIG. 2. If the toe portions 20 and 22 of the blank 10 are open, they are closed in a conventional sewing and trimming operation.

It will be seen that the finished garment shown in FIG. 2 is devoid of any seams, except possibly at the closed toe portions 20 and 22, with the leg extensions 30 and 32 and the body portion 34 being joined along the gore lines 38 and 40, at both the front and rear of the blank, formed as the fabric is fashioned by being narrowed and widened along the tapered leg extensions 30 and 32. The body portion 34 together with the extensions 30 and 32 essentially form the panty part of the garment.

When the blank 10 is removed from the knitting machine it defines a generally U-shaped tube with the legs 12 and 14 extending at a somewhat downwardly divergent angle, rather than being generally parallel, because of the inclination of the gore lines 38 and 40 relative to the axis of their respective tubular legs 12 and 14. The angle of divergence can be reduced as shown, however, by employing particular type of stitches in the crotch area 28 of the garment formed by the lower portion of the body portion 34. For example, in this area 28 of the garment the fabric may be unidirectionally rotarily knit with intentionally varied stitch lengths that are substantially smaller than those in the upper portion of the body portion 34. Such shorter stitch lengths in the crotch area 28 are indicated by the heavier shade lines in such area. These shorter and tighter stitches in the crotch area 28 tend to contract that area and render it less stretchable in the walewise direction, thereby providing a more desirable fit or shaping of the garment in the panty part.

Similarly, a variety of tuck and float stitch combinations could be employed in the crotch area, instead of only shortened and tightened stitches, to render this area of the garment less stretchable and to be somewhat contracted in the walewise direction.

Further, because the body portion 34 is made by unidirectional rotary knitting there exists an availability of a wide number of other stitches or stitch combinations in the upper portion of the body portion 34 such as, for example, one-by-one alternating tuck stitches, a two-course tuck followed by a two-course tuck on alternating needles, combinations of tuck and plain stitches, and other various combinations.

Manifestly, the width of the garment through the hip area can be varied by lengthening or shortening the body portion 34 by increasing or decreasing the number of courses therein, while the dimensions of the garment from the crotch 28 to waist 36 can be varied by varying stitch size in the body portion. Further, the length and taper of the leg extensions 30 and 32 can be similarly varied to achieve a better shape for proper fitting of the garment.

The garment blank 10 of this invention is adapted to be knit on a conventional circular knitting machine capable of rotary and reciprocatory knitting. When such a machine is used to knit the panty blank 10 shown in FIG. 1, the cylinder will be supplied with the proper number of needles necessary to produce the desired diameter of tubular fabric in the legs 12 and 14. Knitting of the blank 10 may be started in either of the toe portions 20 and 22, but will be described here as being started with the right-hand toe portion 20. Through conventional pattern control mechanism the needle cylinder is rotated continuously in one direction with all of the needles in active or knitting position so that when yarn is fed to the needles, the seamless tubular toe portions 20, foot portion 16 and leg 12 will be formed. Unidirectional rotary knitting is continued until the leg 12 is the desired length, i.e. until the point indicated by the dotted line 24 is reached. At this point, the machine is switched into reciprocatory knitting and a group of the needles in the cylinder are moved to idle position, while retaining their stitch loops, with the remainder of the needles remaining in active position to start to knit the tapered extension 30. During the knitting of the extension 30, partial courses are formed with each reciprocation of the needle cylinder, and a few needles, e.g. one or two, at the ends of the group of active needles may be successively removed from action with each succeeding partial course, while retaining their stitch loops, to produce narrowed fabric in conventional fashion. Alternatively, the reduction of active needles may be made less frequently than on each succeeding course; for instance every second course. Knitting continues in this manner producing narrowing fabric for the extension 30 until only a predetermined number of needles remain active.

To produce the body portion 34 all of the needles are reactivated and the machine is switched to unidirectional rotary knitting. When the first complete rotary course of the body portion is knit, the gore line 38 is formed at the front and rear of the blank 10. This gore line 38 extends downwardly and inwardly from a point adjacent the upper end of the extension 30 toward the crotch area 28 of the blank 10. The body portion 34 is then knit, with unidirectional circular knitting, with the desired number of courses. Before this unidirectional rotary knitting proceeds, the machine can be arranged to produce any desired stitch variation, including the use of resilient yarns. As mentioned heretofore, it is desirable for the machine to be adjusted to produce a one-by-one alternating tuck stitch formation in the upper areas of the body portion above the crotch, i.e. in that portion of each complete course included in such upper areas.

At the same time other stitch combinations can be used in the crotch area 28, as described heretofore to constrict the fabric in the walewise direction in this area.

After the machine has rotarily knit the desired number of courses for the body portion 34, the machine is switched to reciprocatory knitting and a large group of needles are moved to idle position, while retaining their stitch loops, with the remainder of the needles remaining in active position to start to knit the extension 32. The extension 32 is started on the small group of active needles and as the machine reciprocates the number of needles knitting in succeeding partial courses is increased, e.g. by one or two needles, in each course to thereby gradually widen the fabric in known manner. As additional needles are reactivated at the ends of the partial courses, the fabric of the extension 32 is connected to the fabric of the body portion 34 along the gore line 40 at both front and rear of the blank 10.

The extension 32 is completed when the point indicated by the dotted line 26 at the upper end of the leg 14 is reached. At this point all of the inactive needles of the cylinder are activated and the machine switched into unidirectional rotary knitting to again produce tubular seamless fabric to form the left-hand leg 14, foot portion 18, and toe portion 22.

After knitting of the blank 10 is completed, and the garment is removed from the machine, the top 36 of the body portion 34 is slit walewise to form a waist opening, and the garment may be finished by the sewing in of a waist band 42 as heretofore described.

The seamless knit garment embodying this invention may be knit of any desired type of yarn to achieve the desired results in the garment. Various types of yarns may be incorporated in various portions of the garment. For example, the foot portions 16 and 18, legs 12 and 14, and tapered leg extensions 30 and 32 may be knitted with a fine denier yarn to achieve a lightweight construction, while a heavier yarn may be used in the body portion 34 to produce a high-rise bikini style panty hose.

It also will be noted that the gore lines 38 and 40 divide the fabric areas between portions knit by reciprocatory knitting, i.e. the extension 30 and 32, and portions, i.e. the body portion 34, knit by unidirectional rotary knitting. This tends to relieve the stitches along the gore lines 38 and 40 of undue stress, so that these stitches are not stretched unduly and do not produce open areas in the fabric. Consequently, the strength of the fabric along the gore lines 38 and 40 is enhanced by the present construction, as contrasted to that wherein gore lines divide fabric areas formed by reciprocatory knitting.

Accordingly, it will be seen that the objects of this invention have been fully and effectively accomplished. It will be realized, however, that the specific embodiment shown and described is susceptible of modification without departure from the principles of invention. Hence, the invention encompasses all modifications within the spirit and scope of the following claims.

I claim:

1. In a seamless lower body garment comprising a pair of seamless tubular legs and a rotary knitted tubular body portion knit so as to extend between said legs and defining a crotch area therebetween, said body portion including a walewise slit along at least a portion thereof so as to define a waist opening opposite said crotch area, the improvement comprising reciprocatorily knitted fashioned portions between each of said two leg portions and said body portion, wherein one of said fashioned portions is formed solely of narrowed partial courses and the other of said fashioned portions is formed solely of widened partial courses.

2. A seamless knit panty or the like comprising:

a pair of seamless tubular leg portions;

reciprocatorily knit fashioned extensions integrally with and tapering upwardly from each of said tubular leg portions at the outer sides thereof, wherein the fashioned extensions knit integrally with one of said leg portions is formed solely of narrowed partial courses and the fashioned extension knit integrally with the other of said leg portions is formed solely of widened partial courses;

a tubular body portion knit integrally with and interconnecting said leg portions and extensions, said body portion being rotary knitted throughout with complete courses and extending between said leg portions and defining a crotch area; and said body portion being slit walewise to define a waist opening opposite said crotch area.

3. A panty according to claim 2 in which at least a portion of the fabric in the body portion is of one-by-one alternating tuck stitch construction.

4. A panty according to claim 2 in which at least a portion of the fabric in the crotch area contains a combination of float and tuck stitches to minimize walewise stretchability in said portion.

5. A panty according to claim 2 in which there is a stitch length differential between at least a portion of the fabic in the crotch area and the remainder of the fabric in the body portion to constrict the fabric walewise in said portion of said crotch area.

6. A method of making seamless panties or the like on a circular knitting machine, the steps comprising:

knitting by rotation a plurality of complete courses to form a first tubular leg portion;

knitting by reciprocation a plurality of partial courses to form a first leg extension knit integrally with said first leg portion while fashioning to reduce the width of the extension;

knitting by rotation a plurality of complete courses to form a tubular body portion knit integrally with the first leg portion and the first leg extension;

knitting by reciprocation a plurality of partial courses to form a second leg extension knit integrally with the body portion while fashioning to increase the width of the second extension; and knitting by rotation a plurality of complete courses to form a second tubular leg portion integral with the second extension and the body portion.

7. A method according to claim 6 including the step of knitting at least a portion of the body portion extending between and integral with the first and second leg portions at their upper inner edges with stitch lengths less than those in other portions of the body portion to constrict the fabric walewise in said at least a portion.

8. A method according to claim 6 including the steps of knitting at least a portion of the body portion extending between and integral with the first and second leg portions at their inner edges with a combination of float and tuck stitches to minimize walewise stretchability of the fabric in said at least a portion.

9. A knit lower body garment comprising a panty portion having a waist opening and a pair of seamless circular knit tubular legs connected to and integrally knit at their upper ends with said panty portion, said panty portion being characterized by each half thereof having only a single front and a single rear gore line and a single side gusset, said gore lines being inclined and extending from adjacent the crotch area of the panty portion and generaly upwardly and outwardly therefrom and being directly connected to the upper ends of each of the circular knit legs so that when the garment is worn the outer upper portions of said leg are located a substantial distance above the crotch area of the panty and overlie hip portions of the wearer, said respective single side gussets of said panty portion being respectively knit of partial courses, one being narrowed courses and the other being widened courses, said side gussets forming said upwardly and outwardly inclined front and rear gore lines defining the upper ends of said legs, and the knit courses of at least a portion of each of said side gussets lying in a direction toward and extending between the waist opening and the upper ends of said legs.

10. A method of integrally knitting a lower body garment including a panty portion having a waist opening, a pair of seamless circular knit tubular legs integrally knit at their upper ends with said panty portion, and each half of said panty portion comprising a respective single side gusset therein formed of partial courses, one side gusset being narrowed courses and the other being widened courses and each side gusset being integrally knit with said respective circular legs, said method comprising the steps of reciprocatorily knitting the partial courses of each of the said single side gussets, one by narrowing and the other by widening while directly connecting adjacent ends of the thus formed gussets to portions of the upper circular courses of each of said circular knit legs to form front and rear gore lines therealong extending from adjacent the crotch area of the panty portion and generally upwardly and outwardly therefrom so that when the garment is worn the upper portions of said legs are located a substantial distance above the crotch area of the panty portion and overlie hip portions of the wearer.

* * * * *